US006449368B1

(12) United States Patent
Davis et al.

(10) Patent No.: US 6,449,368 B1
(45) Date of Patent: Sep. 10, 2002

(54) MULTIDIRECTIONAL AUDIO DECODING

(75) Inventors: Mark Franklin Davis, Pacifica; Louis Dunn Fielder, Millbrae; Matthew Conrad Fellers, San Francisco, all of CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 08/819,582

(22) Filed: Mar. 14, 1997

(51) Int. Cl.[7] ..... H04R 5/00
(52) U.S. Cl. ..... 381/1
(58) Field of Search ..... 381/17, 18, 1, 381/61, 63

(56) References Cited

U.S. PATENT DOCUMENTS

| | | | | |
|---|---|---|---|---|
| RE25,652 | E | * 10/1964 | Kennedy | |
| 3,170,991 | A | 2/1965 | Glasgal | |
| 3,219,757 | A | 11/1965 | Palladino | |
| 3,236,949 | A | 2/1966 | Atal et al. | |
| 3,238,304 | A | 3/1966 | Yaita et al. | |
| 3,249,696 | A | 5/1966 | Van Sickle | |
| 3,892,624 | A | 7/1975 | Shimada | |
| 4,060,696 | A | * 11/1977 | Iwahara et al. | 381/1 |
| 4,068,093 | A | 1/1978 | Fidi | |
| 4,118,599 | A | 10/1978 | Iwahara et al. | |
| 4,139,728 | A | 2/1979 | Haramoto et al. | |
| 4,159,397 | A | 6/1979 | Iwahara et al. | |
| 4,192,969 | A | 3/1980 | Iwahara | |
| 4,199,658 | A | 4/1980 | Iwahara | |
| 4,208,546 | A | 6/1980 | Laupman | |
| 4,209,665 | A | 6/1980 | Iwahara | |
| 4,218,585 | A | 8/1980 | Carver | |
| 4,309,570 | A | 1/1982 | Carver | |
| 4,356,349 | A | 10/1982 | Robinson | |
| 4,388,494 | A | 6/1983 | Schone et al. | |
| 4,394,537 | A | 7/1983 | Shima et al. | |
| 4,567,607 | A | 1/1986 | Bruney et al. | |
| 4,603,429 | A | 7/1986 | Carver | |

(List continued on next page.)

FOREIGN PATENT DOCUMENTS

| | | |
|---|---|---|
| EP | 0637191 | 2/1995 |
| EP | 0639038 | 2/1995 |
| EP | 0664661 | 7/1995 |
| EP | 0724378 | 7/1996 |
| GB | 394325 | 6/1933 |

(List continued on next page.)

OTHER PUBLICATIONS

"Prospects for Transaural Recording," Duane H. Cooper and Jerald L. Bauck, *J. Audio Eng. Soc.*, Vol. 37, No. 1/2, Jan./Feb. 1989, pp. 3–19.

"Theory and Design of a Digital Audio Signal Processor for Home Use," David Griesinger, *J. Audio Eng. Soc.*, vol. 37 No. 1/2, Jan./Feb. 1989, pp. 40–50.

(List continued on next page.)

*Primary Examiner*—Forester W. Isen
*Assistant Examiner*—Brian Pendleton
(74) *Attorney, Agent, or Firm*—Gallagher & Lathrop; Thomas A. Gallagher

(57) ABSTRACT

An audio crosstalk-cancelling network that may be implemented in software, such that when run in real time on a personal computer, the canceller has very low mips requirements and uses a small fraction of available CPU cycles. The network is particularly useful for rendering surround sound images outside the space between left and right computer multimedia loudspeakers when the audio from such sources is reproduced. The network includes two signal feedback paths, each feedback path having a time delay and frequency dependent characteristic. The frequency dependent characteristic represents the smoothed difference in the attenuation in the acoustic path between a transducer and the listener's ear farthest from said transducer and the attenuation in the acoustic path between the same transducer and the listener's ear closest to said same transducer. The smoothed difference in the attenuation is implemented by one or more simple digital filters requiring low processing power.

15 Claims, 6 Drawing Sheets

U.S. PATENT DOCUMENTS

| | | | | | |
|---|---|---|---|---|---|
| 4,625,326 | A | | 11/1986 | Kitzen et al. | |
| 4,661,851 | A | * | 4/1987 | Muterspaugh | 381/196 |
| 4,696,035 | A | | 9/1987 | Torelli et al. | |
| 4,700,389 | A | | 10/1987 | Nakayama | |
| 4,706,287 | A | | 11/1987 | Blackmer et al. | |
| 4,782,530 | A | | 11/1988 | Torelli et al. | |
| 4,893,342 | A | | 1/1990 | Cooper et al. | |
| 4,908,858 | A | | 3/1990 | Ohno | |
| 4,910,778 | A | | 3/1990 | Barton | |
| 4,910,779 | A | | 3/1990 | Cooper et al. | |
| 4,975,954 | A | | 12/1990 | Cooper et al. | |
| 5,034,983 | A | | 7/1991 | Cooper et al. | |
| 5,056,149 | A | | 10/1991 | Broadie | |
| 5,095,507 | A | | 3/1992 | Lowe | |
| 5,095,798 | A | | 3/1992 | Okada et al. | |
| 5,136,651 | A | | 8/1992 | Cooper et al. | |
| 5,173,944 | A | | 12/1992 | Begault | |
| 5,208,493 | A | | 5/1993 | Lendaro et al. | |
| 5,301,236 | A | | 4/1994 | Iizuka et al. | |
| 5,319,713 | A | | 6/1994 | Waller et al. | |
| 5,333,200 | A | | 7/1994 | Cooper et al. | |
| 5,381,482 | A | | 1/1995 | Matsumoto et al. | |
| 5,384,851 | A | | 1/1995 | Fujimori | |
| 5,412,732 | A | | 5/1995 | Kanishi et al. | |
| 5,418,856 | A | | 5/1995 | Okamoto | |
| 5,420,929 | A | | 5/1995 | Geddes et al. | |
| 5,436,975 | A | | 7/1995 | Lowe et al. | |
| 5,438,623 | A | * | 8/1995 | Begault | 381/17 |
| 5,440,639 | A | | 8/1995 | Suzuki et al. | |
| 5,517,570 | A | | 5/1996 | Taylor | |
| 5,524,053 | A | | 6/1996 | Iwamatsu | |
| 5,533,129 | A | | 7/1996 | Gefvert | |
| 5,546,465 | A | | 8/1996 | Kim | |
| 5,579,396 | A | * | 11/1996 | Iida et al. | |
| 5,581,618 | A | * | 12/1996 | Satoshi et al. | |
| 5,598,478 | A | * | 1/1997 | Tanaka | |
| 5,659,619 | A | | 8/1997 | Abel | |
| 5,862,227 | A | * | 1/1999 | Orduna-bustamante et al. | 381/17 |
| 5,889,867 | A | * | 3/1999 | Bauck | 381/1 |

FOREIGN PATENT DOCUMENTS

| | | |
|---|---|---|
| GB | 781186 | 8/1957 |
| GB | 871992 | 7/1991 |
| JP | 57 104400 | 6/1982 |
| JP | 6-165296 | 6/1994 |
| JP | 8-009499 | 1/1996 |
| JP | 8-019100 | 1/1996 |
| JP | 8-182097 | 7/1996 |
| WO | WO9000851 A | 1/1990 |
| WO | 9401981 | 1/1994 |
| WO | WO96/06515 | 2/1996 |
| WO | 9606515 | 2/1996 |

OTHER PUBLICATIONS

Nelson, P. A., et al., "Adaptive Inverse Filters for Stereophonic Sound Reproduction," IEEE Transactions on Signal Processing, IEEE (New York), vol. 40 (No. 7), pp. 1621–1632, (Jul. 1, 1992).

Bourget, C. et al., "Inverse Filtering of Room Impulse Response for Binaural Recording Playback Through Loudspeakers," Proceedings fo the International Conference on Acoustics, Speech, Signal Processing, Institute of Electrical and Electronics Engineers (Adelaide), p. III–301–04, (Apr. 19, 1994).

Bauck, J., et al., "Generalized Transaural Stereo and Applications," Journal of the Audio Engineering Society, Audio Engineering Society, vol. 44 (No. 9), pp. 683–705, (Sep. 2, 1996).

* cited by examiner

MULTIDIRECTIONAL AUDIO DECODING

FIELD OF THE INVENTION

The invention relates to multidirectional audio decoding. More particularly, the invention relates to a computer-software-implemented acoustic-crossfeed canceller using very low processing resources of a personal computer for use in a multidirectional audio decoding and presentation system.

BACKGROUND OF THE INVENTION

Multichannel audio for personal computer-based multimedia video games, CD ROMs, Internet audio and the like (often referred to as "multimedia audio") has emerged as a new application for the Dolby Surround and Dolby Digital multichannel sound encoding and decoding systems.

Dolby Surround, based on the use of a 4:2:4 amplitude-phase matrix, has heretofore become well known as a system for encoding four audio channels (left, right, center and surround) on two channel audio media (cassettes and compact discs), radio transmissions and the audio portions of video recordings (video tapes and laser discs), and television broadcasts, and for decoding therefrom. Dolby Surround (and Dolby Surround Pro Logic, which employs an active surround decoder to enhance channel separation) is widely used in home theatre systems, typically requiring a minimum of three loudspeakers (left and right loudspeakers positioned adjacent to the picture display and one surround loudspeaker, behind the audience) and preferably four loudspeakers (two surround loudspeakers instead of one, located at each side of the audience). Ideally, even a fifth loudspeaker is used, to provide a "hard" center channel reproduction.

Dolby Digital employs the Dolby AC-3 digital audio coding technology in which 5.1 audio channels (left, center, right, left surround, right surround and a limited-bandwidth subwoofer channel) are encoded on a bit-rate reduced data stream. Dolby Digital, a newer technology than Dolby Surround, is already widely used in home theatre systems and has been chosen as the audio standard for the digital video disc (DVD) and high definition television (HDTV) in the United States. In a home theatre environment, Dolby Digital requires a minimum of four loudspeakers because it renders two surround channels instead of one.

In the personal computer "multimedia" environment, typically only two loudspeakers are employed, left and right speakers located adjacent to or near the computer monitor (and, optionally, a subwoofer, which may be remotely located, such as on the floor—in the present discussion, the subwoofer is ignored). When presented over the left and right speakers via conventional means, stereo material generally produces sonic images that are constrained to the speakers themselves and the space between them. This effect results from the crossfeed of the acoustic signal from each speaker to the far ear of a listener positioned in front of the computer monitor. Acoustic cancellation and arbitrary source position rendering are aspects of the same common process.

To reproduce Dolby Surround encoded material in a computer environment, certain prior art arrangements employ multiple loudspeaker drivers within a single enclosure in order to simulate the use of multiple loudspeakers. See, for example, U.S. Pat. No. 5,553,149, which is hereby incorporated by reference in its entirety.

Other prior art arrangements have proposed the use of sound image processing employing acoustic-crossfeed cancellation to render the perception that the surround sound information is coming from virtual loudspeaker locations behind or to the side of a listener when only two forward-located loudspeakers are employed. See, for example, published European Patent Application EP 0 637 191 A2 and published International Application WO 96/96515. The origin of the acoustic-crossfeed canceller is generally attributed to B.S. Atal and Manfred Schroeder of Bell Telephone Laboratories (see, for example, U.S. Pat. No. 3,236,949, which is hereby incorporated by reference in its entirety). As originally described by Schroeder and Atal, the acoustic crossfeed effect can be mitigated by introducing an appropriate cancellation signal from the opposite speaker. Since the cancellation signal itself will crossfeed acoustically, it too must be canceled by an appropriate signal from the originally-emitting speaker, and so on.

The present invention is directed to an acoustic crossfeed canceller which may be implemented using very low processing resources of a personal computer particularly for use in a multidirectional audio decoding and presentation system such as a computer multimedia system having only two main loudspeakers.

SUMMARY OF THE INVENTION

In accordance with the present invention, an acoustic crossfeed canceller is provided, intended for implementation in software, such that when run in real time on a personal computer, the canceller has very low mips requirements and uses a small fraction of available CPU cycles. Thus, for example, the program could be included with video games, CD ROMs, Internet audio and the like, rendering surround sound images outside the space between left and right computer multimedia loudspeakers when the audio from such sources is reproduced.

In an ideal reproduction system, if a source recording has M channels, each having an associated source direction, the listener should perceive these M channels reproduced from their respective M source directions. In practical reproduction systems, the M source channels are reproduced by N presentation channels or loudspeakers, each having a position with respect to the original source directions and with respect to one or more listeners (each stationary listener having a listening position P at each ear). The overall system may be expressed as:

$$M \Rightarrow [C] \Rightarrow N \Rightarrow [R] \Rightarrow P$$

where [C] is an M×N port filter network C which processes or maps the M source channels to the N presentation channels (i.e., linear, time-invariant mapping) and [R] is an N×P port filter network R which processes or maps the N presentation channels to P listening positions (also linear, time-invariant mapping).

The filter network R may be represented by a room matrix R of filter responses or transfer functions (in practice, head related transfer functions or HRTFs), determined by measuring or estimating the transfer function from each of the N presentation channels to each of the P listening positions, forming an N×P matrix of transfer functions, each of which may include the effects of loudspeaker response deviations, room acoustics, delays, echoes, possible head shadow, etc.:

$$R \equiv \begin{bmatrix} r_{11} & r_{12} & \cdots & r_{1p} \\ r_{21} & r_{22} & \cdots & r_{2p} \\ \cdots & \cdots & \cdots & \cdots \\ r_{n1} & r_{n2} & \cdots & r_{np} \end{bmatrix},$$

where the matrix elements $r_{11} \ldots r_{np}$ are individual filter responses representing the transfer function from each presentation channel to each listening position. If the matrix elements $r_{11} \ldots r_{np}$ are frequency domain transfer functions expressed, for example, as fast fourier transforms (FFTs), standard matrix operations (addition, multiplication, etc.) may be accomplished with the matrix. In accordance with the present invention, the room matrix may be simplified by ignoring all but the time delay and frequency dependent attenuation in the direct acoustic path between each presentation channel and each listening position and by smoothing the attenuation response throughout at least a substantial portion of the audio sound spectrum intended to be reproduced by said presentation channels.

The filter network C constitutes an acoustic crossfeed canceller and may be represented by a cancellation matrix C of filter responses or transfer functions:

$$C \equiv \begin{bmatrix} c_{11} & c_{12} & \cdots & c_{1n} \\ c_{21} & c_{22} & \cdots & c_{2n} \\ \cdots & \cdots & \cdots & \cdots \\ c_{m1} & c_{m2} & \cdots & c_{mn} \end{bmatrix},$$

where the matrix elements $c_{11} \ldots c_{mn}$ are individual filter responses. If the matrix elements $c_{11} \ldots c_{mn}$ are frequency domain transfer functions expressed, for example, as fast fourier transforms (FFTs), standard matrix operations (addition, multiplication, etc.) may be accomplished with the matrix.

Because it restores the M source channels to their original directions, the acoustic-crossfeed canceller has the ability to create phantom or virtual images—sounds apparently come from directions M rather than loudspeaker N positions, which N positions may be differently located than the M sources with respect to the listening positions P.

An acoustic crossfeed canceller functions in the nature of a "spatial inverse" filter in a sound reproduction system to cancel a listening room's acoustics and substitute instead the acoustics of the original recording. So that the listener hears the original M channels at the P listening positions as is desired, let $$CR=I,$$

where I is the identity matrix, or $$C=R^{-1}.$$

Thus, the matrix C, may be determined by establishing the room matrix R and taking its inverse. Because the room matrix R is simplified, in accordance with the present invention, the resulting canceller matrix C will also be simplified, resulting in simpler software realizations of the audio crosstalk-cancelling network C, which realizations minimize the processing resource requirements when run on a personal computer.

If the elements of the R matrix are frequency-domain transfer functions, its inverse may be calculated in order to derive the cancellation matrix C. One or more software realizable M×N port audio crosstalk-cancelling networks may then be derived from the cancellation matrix C. In the resulting M×N port network, each output N is, depending on the realization, either (1) the linear combination of separately-filtered versions of the M inputs, (2) the linear combination of separately-filtered versions of the M inputs and separately-filtered feedback signals from the N outputs, or (3) separately-filtered feedback signals from the N outputs added to the M inputs.

One way of realizing the network is to transform the elements of the matrix C to time domain representations, from which FIR filter realizations are readily obtained, as is well known. Although an IIR filter realization is preferred in order to minimize processing resources, obtaining an IIR filter from an FIR filter is not a simple process. Thus, instead of transforming the matrix C elements to the time domain, it is preferred to leave them in the frequency domain from which their filter amplitude and phase responses are readily obtained. In turn, simple IIR or FIR/IIR filter realizations, including their filter coefficients, requiring low processing power, may be realized which implement the desired amplitude and phase responses. Although such IIR or FIR/IIR filters may be derived by trial and error techniques, in practice, a better way to realize such IIR or FIR/IIR filters is to employ one of the many off-the-shelf digital-filter-design computer programs.

If the room matrix R is not a square matrix, the canceller inverse matrix C is a "pseudo matrix inverse" but is still the optimal way to map M source channels onto N presentation channels for presentation at P listener positions. For the underconstrained case (i.e., P is less than N), the pseudo inverse minimizes the RMS error between actual and desired solutions. For the overconstrained case (i.e., P is greater N), the pseudo inverse minimizes the RMS energy of the input (s) needed to achieve exact solution.

As will be understood from the above discussion, the principles of the present invention are applicable generally to arbitrary numbers of source channels, loudspeakers and listening positions. However, for simplicity, the preferred embodiments described below relate to the specific case in which there are two loudspeakers (such as in a typical computer multimedia arrangement, the speakers narrowly and symmetrically spaced in front of the listener, as on either side of a multimedia computer monitor or TV set), two source channels (such as, but not limited to, left surround and right surround), and two listening positions (a listener's ears) such that N=M=P=2. Thus, the acoustic transfer room matrix R is a 2=2 matrix and the canceller's response, C, is represented by the 2×2 matrix that is the inverse of the R matrix such that the left source channel L is perceived only at the left ear (one of the two listener positions P) while the right source channel R is perceived only at the right ear (the other of the two listener positions P).

Signals applied via such an acoustic crosstalk canceller to a pair of loudspeakers adjacent to a computer monitor result in the perception that the sound is coming from the sides of the listener rather than where the speakers are located—forward direction cues are lost and the sound seems to come from the side only, where the surround speakers should be. Thus, by applying left and right channel information directly to the loudspeakers and summing that information with spatialized surround information (i.e., surround information processed by the crosstalk canceller), only two loudspeakers, located adjacent to the computer monitor, are required to render the perception of left, right and surround sound fields.

In one of its aspects, the present invention is directed to a method of deriving a cancellation matrix C of dimension M×N in which each of the matrix elements is a frequency-domain transfer function, the matrix C representing an M×N port audio crosstalk-cancelling network for mapping M audio source channels, each having an associated source direction, to N audio presentation channels, each having a position relative to the source directions, such that each output N is either (1) the linear combination of separately-filtered versions of the M inputs, (2) the linear combination of separately-filtered versions of the M inputs and separately-filtered feedback signals from the N outputs, or (3) separately-filtered feedback signals from the N outputs added to the M inputs. The method comprises establishing a room matrix R of dimension N×P in which each of the matrix elements is a frequency-domain transfer function, the matrix R representing an N×P port network for mapping N presentation channel positions to P listening positions, wherein the frequency-domain transfer functions represent the time delay and a smoothed version of the frequency dependent attenuation along a direct acoustic path from each one of said presentation channel positions to each one of said listening positions, and setting the crosstalk-cancelling matrix C equal to the inverse of the room matrix R. The smoothed version of the frequency dependent attenuation may be, for example, a smoothed average of said acoustic path attenuation throughout at least a substantial portion of the audio sound spectrum intended to be reproduced by the presentation channels.

In another of its aspects, the invention is directed to an M×N port audio crosstalk-cancelling network for mapping M audio source channels, each having an associated source direction, to N audio presentation channels, each having a position relative to the source directions, such that each output N is either (1) the linear combination of separately-filtered versions of the M inputs, (2) the linear combination of separately-filtered versions of the M inputs and separately-filtered feedback signals from the N outputs, or (3) separately-filtered feedback signals from the N outputs added to the M inputs. The cross-talk cancelling network is produced by the steps of establishing a room matrix R of dimension N×P in which each of the matrix elements is a frequency-domain transfer function, the matrix R representing an N×P port network for mapping N presentation channel positions to P listening positions, wherein the frequency-domain transfer functions represent the time delay and a smoothed version of the frequency dependent attenuation along a direct acoustic path from each one of the presentation channel positions to each one of the listening positions, deriving the inverse of the room matrix R to produce a crosstalk-cancelling matrix C of dimension M×N in which each of the matrix elements is a frequency-domain transfer function, the matrix C representing the M×N port audio crosstalk-cancelling network, and implementing the smoothed version of the frequency dependent attenuation by one or more simple digital filters requiring low processing power. The digital filters preferably are of the IIR type or IIR/FIR type and preferably are first-order filters. The smoothed version of the frequency dependent attenuation may be, for example, a smoothed average of said acoustic path attenuation throughout at least a substantial portion of the audio sound spectrum intended to be reproduced by the presentation channels. The time delay may be realized by a digital ring buffer.

According to a further aspect of the present invention, the M×N port audio crosstalk-cancelling network may include an amplitude compressor, the compressor comprising fixed amplitude level attenuators in each of the network's inputs, and variable amplitude level boosters in each of the network's outputs, the boosters each including a scaler for scaling the boost between a level which restores the input attenuation and an attenuated level which avoids clipping in the output signal. In a preferred embodiment, control for the compressor is obtained from the compressor input, the compressor has an infinite compression ratio, thereby constituting a limiter. In the preferred embodiment, the compressor further includes a delay in each of the network's outputs and wherein the control for the compressor looks ahead in order to syllabically control the compressor's gain. The fixed amplitude level attenuators and variable amplitude level boosters may have frequency-independent characteristics. Alternatively, the fixed amplitude level attenuators and variable amplitude level boosters have frequency dependent characteristics. When the crosstalk processor is noisy at low signal levels, as it may be when an inexpensive processor is employed, such as DSP chips supporting only 16-bit word lengths, the frequency dependent characteristics of said fixed amplitude level attenuators and variable amplitude level boosters operate only at mid to low frequencies, thus keeping the loss in signal-to-noise ratio low and limiting the loss to frequencies where it is less inaudible.

In another aspect of the invention, the audio crosstalk-cancelling network is a 2×2 port network for mapping two audio source channel inputs M to two audio presentation channel output N applied to a pair of transducers having positions relative to the directions of the audio source channels M, the listener having two listening positions P, the listener's left ear and the listener's right ear, relative to the transducers, the network further comprising (1) two signal combiners, a first signal combiner and a second signal combiner, each signal combiner having at least two inputs and an output, wherein (a) one of the M inputs is coupled to an input of the first signal combiner and another of the M inputs is coupled to an input of the second signal combiner, and (b) one of the N outputs is coupled to the output of the first signal combiner and another of the outputs is coupled to the N output of the second signal combiner, and (2) two signal feedback paths, a first signal feedback path and a second signal feedback path, each feedback path having a time delay and frequency dependent characteristic, and each feedback path having an input and an output, wherein (a) the input of the first signal feedback path is coupled to the output of the first signal combiner and the output of the first signal feedback path is coupled to the other input of the second signal combiner, (b) the input of the second signal feedback path is coupled to the output of the second signal combiner and the output of the second signal feedback path is coupled to the other input of the first signal combiner, (c) each of the feedback paths has a time delay representing the additional time for sound to propagate along the acoustic path between a transducer and the listener's ear farthest from the transducer with respect to the time for sound to propagate along the acoustic path between the same transducer and the listener's ear closest to the same transducer, and (d) each of the feedback paths has a frequency dependent characteristic representing the difference in the attenuation in the acoustic path between a transducer and the listener's ear farthest from the transducer and the attenuation in the acoustic path between the same transducer and the listener's ear closest to the same transducer, and (3) the signal combiners, signal feedback paths, and couplings therebetween having polarity characteristics such that signals processed by a feedback path are subtractively combined with signals coupled to the other input of the respective signal combiner. The two presentation channels may be applied to a pair of transducers, arranged generally in front of and at substantially right-and-left symmetrical positions with respect to a listener. The frequency dependent characteristic may be realized as a first-order low-pass shelving characteristic, which may be implemented by an IIR filter or a combination FIR/IIR filter. The attenuation in the acoustic path between a transducer and the listener's ear farthest from the transducer is determined by taking the difference between the head related transfer response from a transducer and the listener's ear farthest from the transducer and the head related transfer response from the other transducer to the listener's ear closest to the other transducer and smoothing the difference.

Various aspects of the invention may be used independently or in combination with each other.

DETAILED DESCRIPTION OF THE PREFERRED EMBODIMENTS

As mentioned above, the required response of an acoustic canceller can be calculated by measuring the effective response of the crosstalk process (each speaker to each ear), and calculating an inverse response by inverting the matrix of its system functions. One or more software realizations of the inverse response may then be derived, as explained above. However, because of the simple nature of the crosstalk process in the 2×2 case (2 speakers, 2 ears), it is possible to arrive at the inverse response in a more intuitive fashion.

The primary difference between a given acoustic signal reaching the near ear and the same signal reaching the far ear is that the far ear signal is delayed and attenuated slightly relative to the near-ear arrival. Generation of a canceling signal therefore involves subtracting from the opposite channel a signal similarly delayed and attenuated.

An acoustic crosstalk canceller employs the basic concept of active noise cancellation—i.e., the cross-talk signal from the left loudspeaker heard in the right ear is cancelled out by applying a phase-inverted, time-delayed, amplitude-reduced and frequency-dependently-filtered version of the same signal to the right channel and vice-versa. Each phase-inverted signal must in turn be cancelled in the same manner (at least for several iterations).

Figure 1:
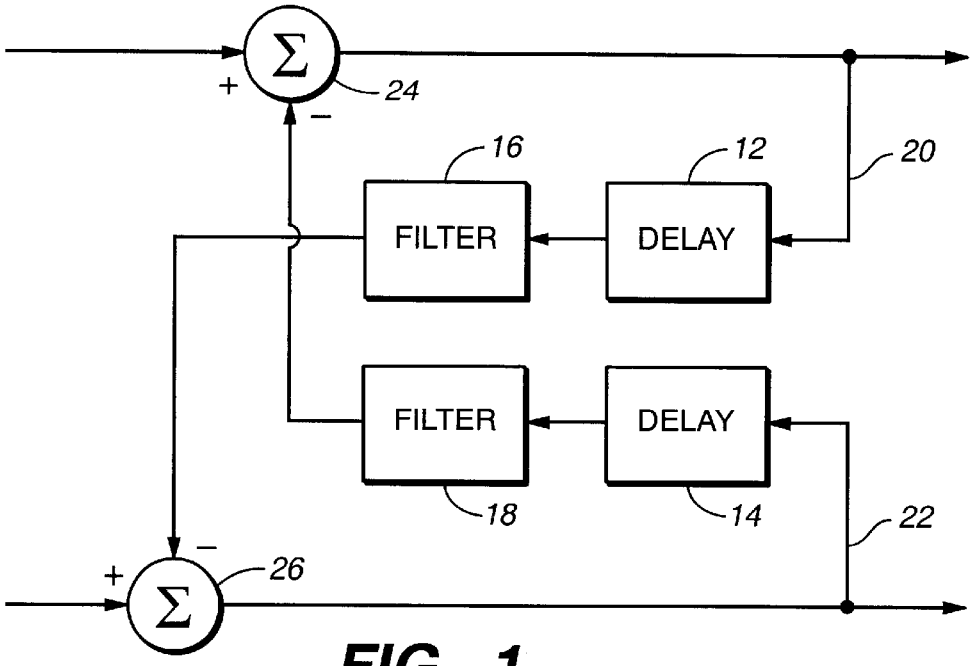
FIG. 1 is a functional block diagram of a simple four-port acoustic crosstalk canceller.

FIG. 1 is a functional block diagram showing the basic elements of a simple canceller. Each delay 12 and 14 is typically about 140 μsec (microseconds) for speakers forwardly located with respect to a listener at +/−15 degree angles (a delay of about 6 samples at a 44.1 kHz sampling rate). Each of the filters 16 and 18 is simply a frequency independent attenuation factor, K, typically about 0.9. The input of each crossfeed leg 20 and 22 is taken from the output of an additive summer (24 and 26, respectively) in a cross channel negative feedback arrangement (each leg is subtracted at the respective summer), to generate a canceller of each previous canceller signal, as explained above. This is a very simple acoustic crosstalk canceller to realize digitally: two summations, two multiplications, and a pair of 6-sample ring buffers for the delays. Thus, in this realization, the N outputs of the M×N port network are the separately filtered feedback signals from the N outputs added to the M inputs.

However, the simple canceller just described fails to account for the fact that the attenuation introduced in the far acoustic path is frequency dependent. It is well known that the frequency characteristic of such acoustic paths may be derived by measuring binaural impulse responses using a human head or a dummy head, usually measured in an anechoic environment. Published data reflecting such measurements is widely available. For example, usable binaural impulse responses include those taken with a Kemar brand dummy head in an anechoic environment by the MIT Media Lab, and published on their Internet World Wide Web site. Using such data, the dB magnitude values of the Fourier transforms of the left and right ear impulse responses for sources at 15 degrees are subtracted to arrive at a differential frequency response corresponding to speakers at +/−15. This raw difference spectrum is shown in FIG. 2 as response A, a rather complex characteristic which would require a multipole filter realization.

Figure 2:
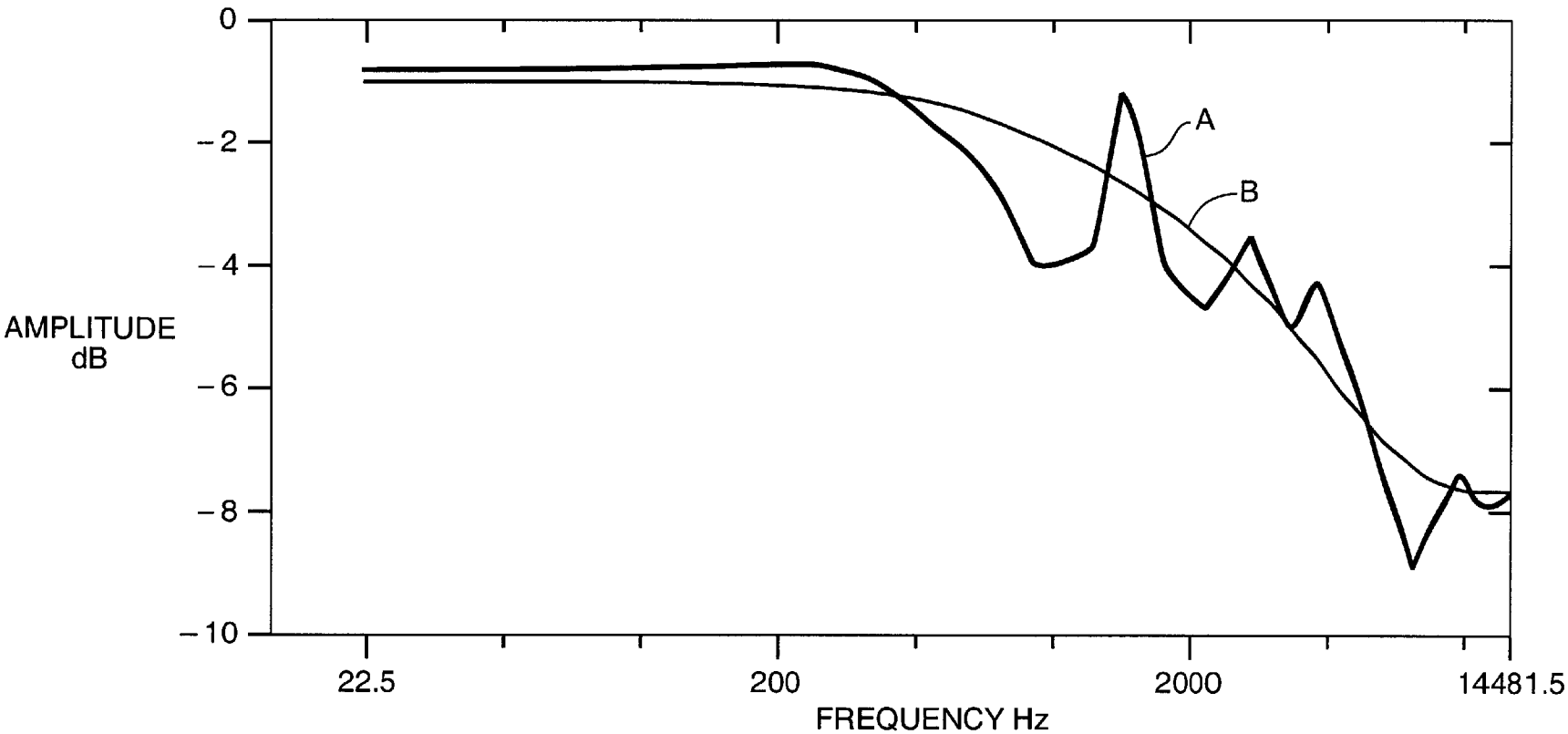
FIG. 2 shows plots of the amplitude of two acoustic response characteristics versus frequency: response A is the difference of left and right ear impulse responses for sources at ±15 degrees and response B is a smoothed version of response A.

One aspect of the present invention is to smooth a response such as response A in FIG. 2, in order to simplify the resulting filter realization, thereby minimizing computer processor resources. Another aspect of the present invention is the implementation of the smoothed response by a first order filter section, which, when realized, requires very low processing power. The response of a first-order filter section providing a desirable smoothing is, for example, response B in FIG. 2. The desired response is a smoothed average of the acoustic path attenuation throughout at least a substantial portion of the audio sound spectrum intended to be reproduced by said presentation channels. Trying to approximate the response with any more preciseness will not yield benefits because there are so many sources of error: mismatched speakers, speakers not same distance from listener, the listener's head is not symmetrical, abnormal width head, etc. In practice, the response of a first order filter approximates the ideal characteristic closely enough so that the resulting crosstalk canceller is effective for most listeners.

Figure 3:
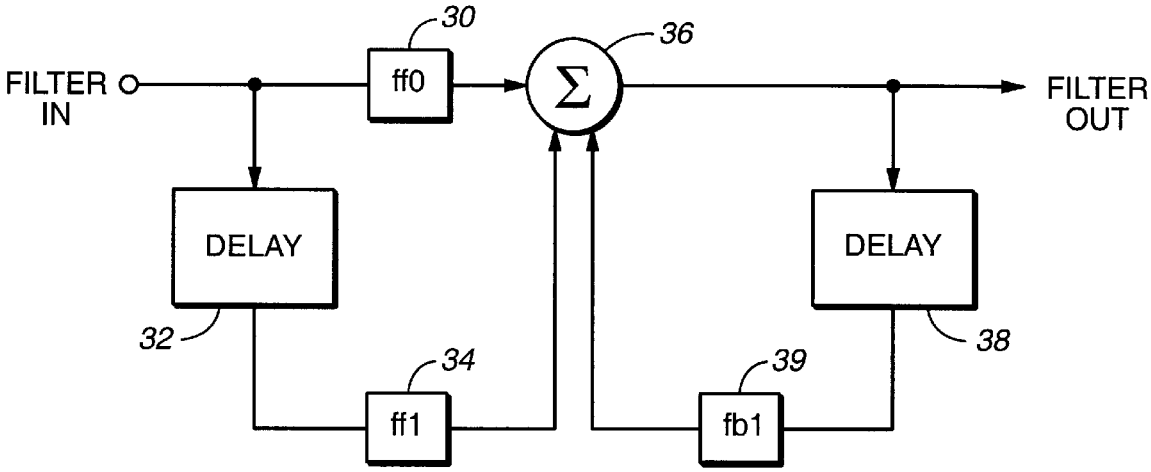
FIG. 3 is a functional block diagram of a simple, first order filter usable in the simple acoustic crosstalk canceller of FIG. 1 to realize a smoothed version of the difference of left and right ear impulse responses.

A smoothed response, such as response B of FIG. 2, may be realized by employing the FIR/IIR filter of FIG. 3 in place of each of the wideband (frequency-independent) attenuating filters 16 and 18 of FIG. 1 (i.e., replace the attenuation constant K with a first order filter). Functionally, as shown in the filter realization of FIG. 3, the filter input is applied to a first scaler (ff0) 30 and to a first delay 32. The delay 32 output is applied to a second scaler (ff1) 34. An additive summer 36, having several inputs and an output, receives the outputs of scaler 30 and scaler 34. The summer 36 output provides the filter output which is also fed back via a second delay 38 and a third scaler (fb1) 39 to another input of summer 36. For +/−15 degree speakers and a sampling rate (fsampling) equal to 44.1 kHz, the filter coefficients for the realization shown are ff0=0.4608, ff1=0.2596, and fb1=0.7702. Delays 32 and 38 may be implemented by ring buffers. The choices of ff0, ff1, fb1, and the number of samples in the two ring buffer delays depend on the sampling frequency and speaker spacing. The number of samples in the delays is typically in the range of 1 to 7 for practical speaker angles and sampling rates (about 6 samples for ±15 degree speakers and fsampling=44.1 kHz).

In accordance with another aspect of the present invention, the filter realization of the smoothed difference response is implemented by a first order IIR or FIR/IIR filter. If implemented using an FIR filter, feed forward with multiple delays would be required in order to provide multiple iterations of the required cross cancelling. Such an implementation is processor intensive. On the other hand an IIR or FIR/IIR realization inherently provides multiple delays with much greater simplicity and lower processor demands.

The filter realization shown in FIG. 3 constitutes a hybrid FIR/IIR filter—the feed forward portion (scaling the input by ff0 and applying it to a summer 34 and delaying the input, scaling it by ff1 and applying it to the summer 34) constitutes an FIR filter and the feedback portion (delaying the output, scaling it by fb1 and applying it to the summer 34) constitutes an IIR filter.

The frequency dependent characteristic of such an FIR/IIR filter is often referred to as a low-pass shelving characteristic. When the audio signal processing apparatus outputs are for application to a pair of transducers spaced at about ±15 degrees, the low-pass shelving characteristic has a first inflection point at about 2000 Hz and a second inflection point at about 4370 kHz. When the audio signal processing apparatus outputs are for application to a pair of transducers spaced at about ±20 degrees, the low-pass shelving characteristic has a first inflection point at about 1600 Hz and a second inflection point at about 4150 kHz.

The sampling rate is not critical. A rate of 44.1 kHz is suitable for compatibility with other digital audio sources and to provide sufficient frequency response for high fidelity reproduction. Other sampling rates may be used (such as, but not limited to 48 kHz, 32 kHz, 22.05 kHz, and 11 kHz). When the filters 16 and 18 of FIG. 1 are realized by a filter such as shown in FIG. 3 in which the inversion is handled by choice of sign of the ff0 and ff1 terms, the subtraction (minus) signs on the summers 24 and 26 (FIG. 1) are replaced with addition (plus) signs.

Figure 4A:
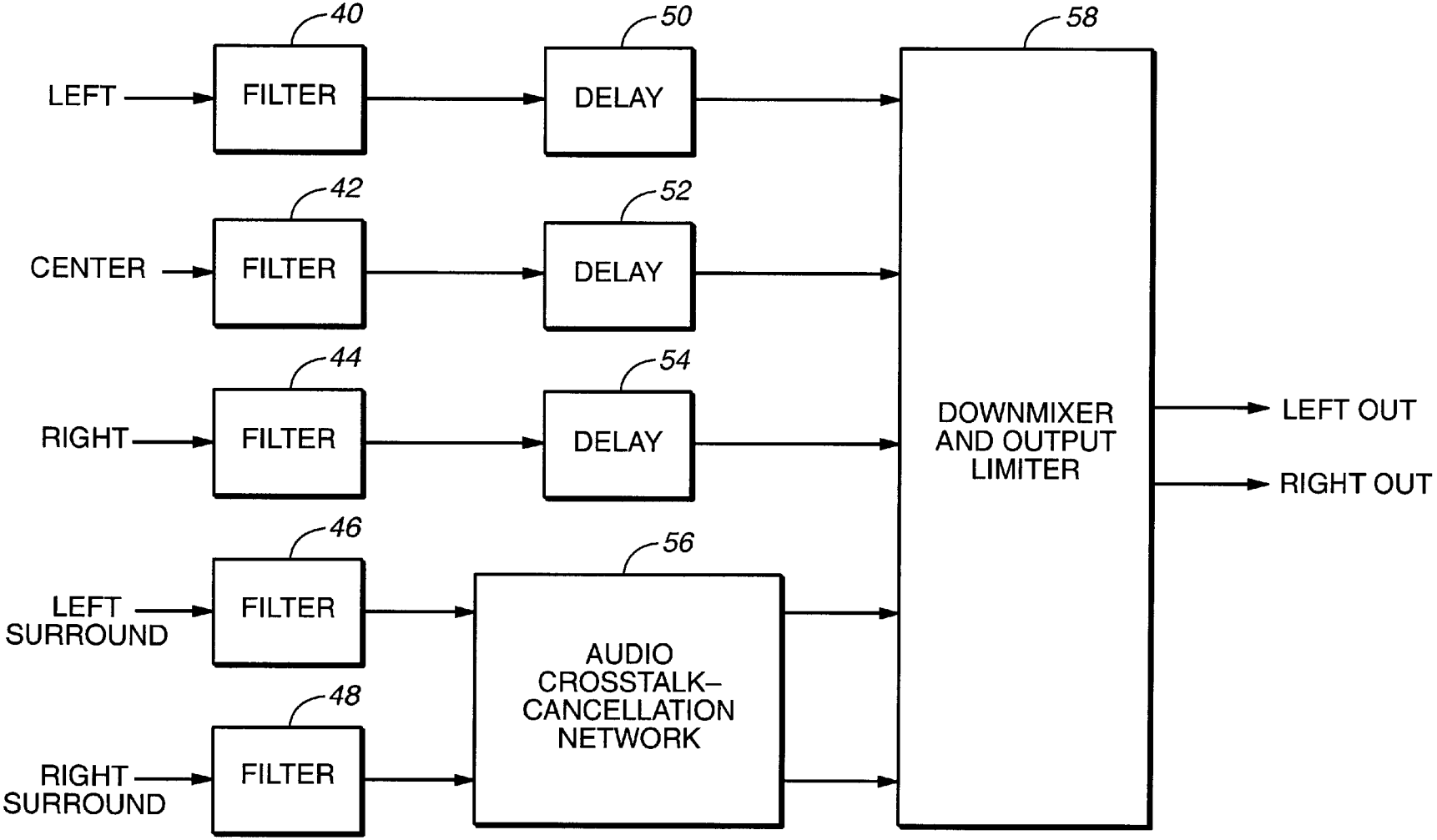
FIG. 4A is a functional block diagram showing a preferred environment in which the audio crosstalk-cancellation network of the present invention can be employed.

FIG. 4A is a functional block diagram showing a preferred environment in which the audio crosstalk-cancellation network of the present invention can be employed. Five digital audio input signals, left, center, right, left surround and right surround, such as from an Dolby Surround AC-3 decoder (not shown) are received. The inputs are applied, respectively, to optional DC blocking filters 40, 42, 44, 46 and 48, each having a high pass response (−3 dB at 20 Hz) (DC blocking filters may not be necessary, depending on the signal source feeding them). Optional delays 50, 52 and 54 in the left, center and right input lines have time delays commensurate with the time delay, if any, in the crosstalk-cancellation network 56. Ordinarily, there will be no time delay in the network 56 and delays 50, 52 and 54 are omitted unless network 56 includes an amplitude compressor/limiter of a certain type, as is described below. In this environment, the inputs to the cancellation network 56 are the left surround and right surround inputs (in general, the inputs to network 56 are not limited to being surround inputs). A preferred embodiment of the cancellation network 56 for use in this environment is described in connection with the embodiment of FIG. 5. A downmixer and output compressor/limiter 58 receives the delayed left, center and right signals and the processed surround signals to provide two output signals, left and right, suitable for reproduction by two computer multimedia loudspeakers. Further details of the downmixer and output compressor/limiter 58 are described in connection with FIG. 6. The limiting function of block 58 assures that neither digital output signal exceeds an amplitude of 1.

A decoded AC-3 digital bitstream contains five discrete full bandwidth channels and a subwoofer channel. It is desirable to preserve the discreteness of the channels in the two speaker presentation to the extent possible. Thus, only the Left and Right Surround channels are processed by a cancellation network (nevertheless, in the FIG. 4B alternative, described below, the center channel may also be applied to the network inputs). The left and right front channels are added to the cancellation-network-processed left and right surround channels, respectively. The center channel and subwoofer channel (if used, not shown) are mixed in-phase into the Left and Right outputs without any additional processing.

The arrangement of FIG. 4A may also be employed when there are four input signals (left, center and right channels, a single surround channel and no separate subwoofer channel) such as is provided by a Dolby Surround or Dolby Surround Pro Logic decoder. In that case, the single surround channel should be decorrelated into two pseudo-stereophonic signals, which are in turn applied to the inputs of the canceller. A simple pseudo-stereo conversion may be used employing phase shifting such that one signal is out of phase with the other. Many pseudo-stereo conversion techniques are know in the art.

The arrangement of FIG. 4A may also be employed when there are only two stereophonic input signals. In that case, stereophonic pseudo-surround signals can be created by delaying each of the two stereophonic input signals by about 30 milliseconds. Similarly, even a single monophonic input signal may be used by deriving a pair of pseudo-stereophonic signals to provide the left and right inputs and by delaying each of them to create a pair of pseudo-surround signals.

Figure 4B:
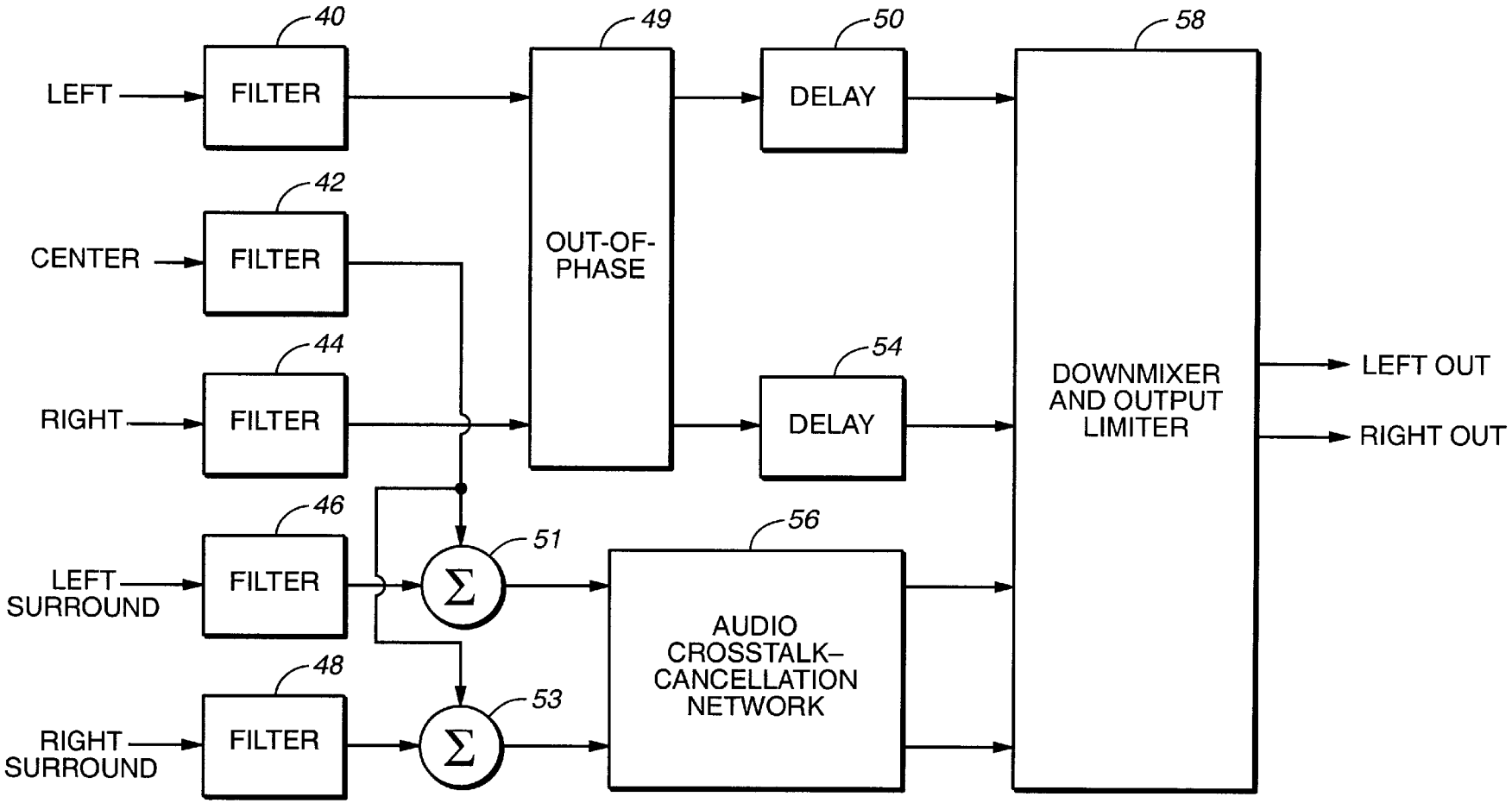
FIG. 4B is a functional block diagram showing an alternative preferred environment in which the audio crosstalk-cancellation network of the present invention can be employed with respect not only to surround channel signals but also to the main left and right signals.

FIG. 4B shows additional alternatives to the embodiment of FIG. 4A. In FIG. 4B, the left and right front channels are widened slightly by partial antiphase mixing in block 49. Although antiphase mixing to widen the apparent stereo "stage," is a well-known technique, it is an aspect of the present invention to realize such mixing by a matrix calculation in the same manner that the crosstalk canceller is realized (as noted above, acoustic cancellation and arbitrary source positioning are aspects of the same process). Thus, the antiphase mixing calculation realization of block 49 constitutes another M×N port network represented by a matrix C, in which M and N=2 and the audio crosstalk cancellation network embodiment of FIG. 1/FIG. 3 may be employed. In this case, because the desired position change is slight (i.e., the spacing of the left and right sources M with respect to typical computer monitor loudspeaker spacings is much closer than when the sources M are surround sources), the matrix operations are simpler than for the surround crosstalk canceller, requiring fewer processor resources.

As another option, the center channel may be cancelled in order to minimize the coloration that results from having the center signal heard twice by each ear—once from near speaker and again from far speaker. Rather than requiring a separate canceller realization, the center channel acoustic crossfeed signals can be cancelled by applying them to the surround channel crosstalk-cancellation network. Thus, the center channel signal is mixed into the left surround and right surround inputs to the crosstalk-cancellation network 56 via additive summers 51 and 53, respectively.

Figure 5:
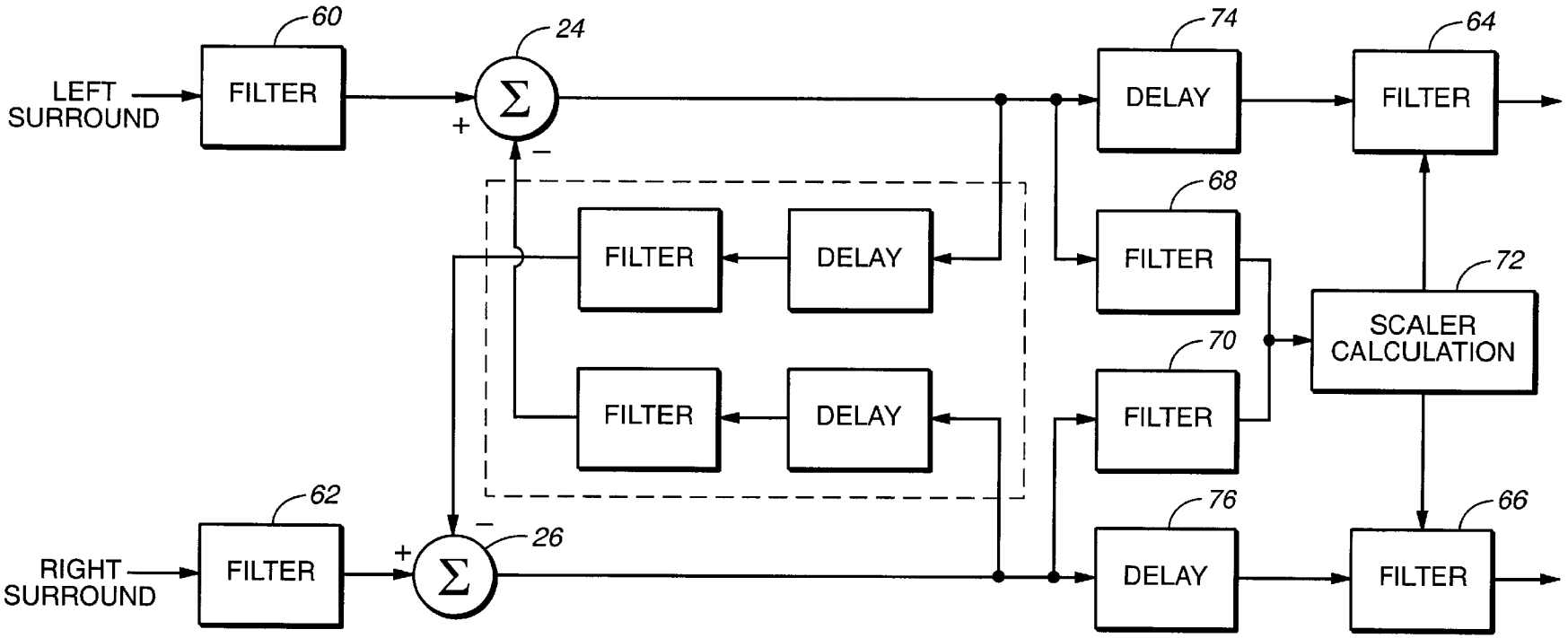
FIG. 5 is a functional block diagram showing the preferred embodiment of the simple 2×2 port canceller of FIGS. 1 and 3 for use in the environments of FIG. 4A or 4B.

FIG. 5 is a functional block diagram showing the preferred embodiment of the simple 2×2 port canceller of FIGS. 1 and 3 for use in the environment of FIG. 4. Elements common to FIG. 1 retain the same reference numerals. FIG. 5 differs from the FIG. 1/FIG. 3 embodiment in that it includes a compressor to avoid clipping high level signals. The canceller should not generate numbers greater than 1.0, but is likely to do so at mid to low frequencies (below about 200 Hz) under certain signal conditions even when the input signals do not exceed 1.0 (this may occur when a signal is applied only to one input or signals applied to both inputs are out of phase with each other). Input high pass filters cannot be used to eliminate the problem-causing low frequencies because such filters, to be effective, cause phase shift disturbances which reduce the canceller's effectiveness and introduce coloration. Thus, in accordance with another aspect of the invention, a low-processing power crosstalk canceller is provided which includes a compressor, the compressor also requiring low processing power.

When the calculations are carried out on a fixed-point processor, the compressor functions by providing a fixed attenuation at the crosstalk canceller's input and a variable boost at the canceller's output. The amount of the fixed attenuation is sufficient to assure that the output of the canceller does not exceed 1.0 under any signal conditions (for example, if when a signal is applied to only one input, the canceller causes a 20 dB boost in that signal, the fixed attenuation is 20 dB). The variable boost is scaled between a level which restores the input attenuation and an attenuated level which avoids clipping in the output signal.

The compressor may be input controlled (the input of the compressor) because, ordinarily, an output controlled compressor must act instantaneously, thereby producing audible artifacts. In an alternative embodiment, described below, an output controlled compressor avoids the production of such audible artifacts. The compressor may be realized with a finite compression ratio, or, with an infinite compression ratio, in which case it is a limiter.

The arrangement of fixed attenuation prior to the canceller followed by variable restoration constitutes an aspect of the present invention. Although variable gain at the input of the canceller would assure against clipping at the canceller's output, sensing for control of the variable gain would necessarily be located at the output of the canceller. However, such a configuration is not feasible because by the time clipping is sensed at the output it is too late to reduce the input gain, particularly in view of the delay in the canceller. Instead, the present invention places both the sensing and variable gain at the output of the canceller in combination with fixed attenuation before the canceller's input. As described further below, delays in the canceller's output signal paths allow a "look ahead" so that the sensing can syllabically control the compressor's gain.

For surround inputs applied to a crosstalk canceller, as in the left half of FIG. 5, the probability of overload, either within the canceller or in subsequent circuitry (either the DACs (digital-to-analog converters) or perhaps power amplifiers or loudspeakers), varies with frequency. One way to prevent such overload is to precede the canceller by "pre-emphasis" using a response which more or less follows the (input) overload level as a function of frequency. Hence if at frequency f the system would overload×dB below input full-scale, we introduce×dB of attenuation at frequency f. This (fixed) pre-emphasis is chosen to ensure that within the canceller no overload can occur.

In a practical realization of the embodiment of FIG. 5, in which the crosstalk canceller is run on inexpensive processing hardware (such as fixed point DSP chips supporting only 16-bit word lengths), both the fixed attenuation and variable boost have frequency dependent characteristics such that the attenuation and boost operate only at mid to low frequencies (below about 200 Hz, for example), thus keeping the loss in signal-to-noise ratio low and limiting the loss to frequencies where it is less inaudible.

In the realization of FIG. 5, the compressor functions by providing a fixed preemphasis at its input, which attenuates low frequencies sufficiently to avoid any clipping in the canceller, and a variable deemphasis at its output, which adjustably restores the low frequencies. The variable deemphasis is scaled between a level which is complementary to the input preemphasis and an attenuated level which avoids clipping in the output signal. Because of the use of preemphasis and variable deemphasis, the effect on signal-to-noise ratio is inaudible even if the crosstalk processor is noisy at low signal levels (as it may be when an inexpensive processor is employed, such as DSP chips supporting only 16-bit word lengths).

While one could restore the overall frequency response and signal level by introducing after the canceller the exact complementary deemphasis, for example, a boost of 20 dB at DC falling on a shelf to 6.7 dB at pi/2, this would of course have no effect on overload within the canceller itself, but might lead to overload downstream. One preferred approach to protect against such overload, shown in the FIG. 5 realization, models the restored response (offset downwards in level to avoid overload) in the two crosstalk canceller outputs, measures the greater of the modelled outputs, estimates whether it indicates that one or other or both of the main outputs would overload, and if clipping is predicted, applies gain reduction immediately prior to the deemphasis. This constitutes a "wideband" compressor/limiter, in that the applied gain change is the same at all frequencies; it does not allow either output to exceed full-scale (or some other desired threshold), irrespective of the frequency content of the signal.

In the realization of FIG. 5, the preemphasis is provided by identical filters 60 and 62. Although the filter characteristics are not critical, each filter may be realized as a first order filter having a shelving response such that its response is −20 dB at DC and −6.7 dB at $\pi/2$ (the Nyquist frequency). The variable deemphasis may be realized by identical scaled filters 64 and 66, each of which, in shape, has a response which is the inverse of that of filters 60 and 62. Filters 64 and 66 each receives the same scaler in order to scale the respective response up and down by 20 dB (the response shape remaining unaltered). The scale factors are generated by filters 68 and 70 and a scaler calculation 72. Delays 74 and 76 delay the outputs of the canceller in order to allow the allow the canceller output sensing to look ahead and syllabically control filters 64 and 66. The time delays of delays 74 and 76 are commensurate with the time delay between the respective inputs to delays 74 and 76 and the scaler outputs of the scaler calculation 72. Delays 74 and 76 may be realized as ring buffers.

Filters 64 and 66 are first order filters, each having a shelving response (a low pass shel—with increasing frequency, the slope starts at unity, increases to a maximum at −6 dB/octave, and then decreases back to unity) varying between +20 dB and 0 dB at DC and between +6.7 dB and −13.3 dB at $\pi/2$, depending on the scaler. Filters 68 and 70 are also low-pass shelving filters, being, however, fixed and having a response of −13.3 dB at $\pi/2$ and 0 dB at DC. The scaler calculation first operates on blocks of samples (8-sample blocks in the practical embodiment) to calculate the maximum absolute value in the respective blocks of samples in the left and right canceller outputs (that is, the block with the largest maximum value of the filter 68 and 70 outputs is selected and the maximum value in that block determines the scaler value). A scale factor is then calculated which sets the level of filters 64 and 66 so that the output does not exceed 1.0. The scale factors are interpolated between the current and previous block so that the compressor acts syllabically and does not generate undesirable artifacts.

If the fixed-point processor on which the crosstalk canceller is running has enough bits (say, 20 bits) so as not to add audible noise at low signal levels, a wideband (frequency-independent) compression scheme may be employed instead of a frequency dependent one. In that case, the inputs may each be subject to a wideband (frequency-independent) attenuation (10 dB, for example) and the output of the canceller applied to a controllable wideband (frequency-independent) amplifier with gain up to 10 dB, the gain being reduced as necessary to prevent the digital output from clipping. Thus filters 60, 62, 68 and 70 become a fixed attenuation at all frequencies of concern, while filters 64 and 66 would lose their frequency dependence and become wideband (frequency-independent) amplifiers at such frequencies.

If the processor on which the crosstalk canceller is running is a floating point processor, the calculation can be done in floating point without input attenuation, allowing intermediate signal levels greater than 1.0 and precluding the need for any compressor action until the output of the crosstalk canceller, thus eliminating the input filters or attenuators and saving processor resources.

Several alternatives to the frequency dependent realization described are possible. In a first alternative, the prediction of clipping may be used to modify the shape of the applied deemphasis rather than to cause an overall gain shift. One way to implement such a deemphasis-shape-modifying approach is to provide initially a wideband gain reduction as the control signal (indicating the likelihood of overload) increases until there is unity gain at high frequencies followed by (as the control signal continues to increase) a progressively increasing low frequency loss while leaving the high frequency gain at unity. Such an approach would not lead to as much "pumping" of middle and high frequency sound components in the presence of dominant low frequency signals. It is noted that one control signal, indicating, for example, by how much the output would be overloaded unless something is done, provides no information as to where in the spectrum the overload-causing signal or signals lie. Nevertheless, for dominant high frequencies (for the sake of example, near pi/2, a highly improbable condition) a gain reduction of more than a certain amount, say 6.7 dB, is never required (i.e., the removal of the 6.7 dB boost of the quiescent de-emphasis, giving therefore unity gain). For dominant low frequencies, a reduction of as much as a certain amount, say 20 dB, (again to unity gain at low frequencies), but at those moments there would be no need to reduce the gain at high frequencies by any amount nearly as much as 20 dB.

Other forms of deemphasis shape adaptation are possible. The benefits of such adaptation are analogous to the benefit offered by bandsplitting in audio signal compressors, namely a reduction in cross-modulation of signals in one part of the spectrum by signals on other parts.

In a further alternative, modelling may be improved to simulate the effect of variable de-emphasis by making blocks 68/70 variable, also. In that case, the compressor/limiter becomes an output controlled compressor/limiter whose control signal is used to operate on the main signals after delays 74/76. The fact that such fast output control causes transient distortion is of no consequence because the outputs of filters 68/70 are not heard. The result is to provide a smoothed control signal for the signal affecting deemphasis provided by blocks 64/66.

Figure 6:
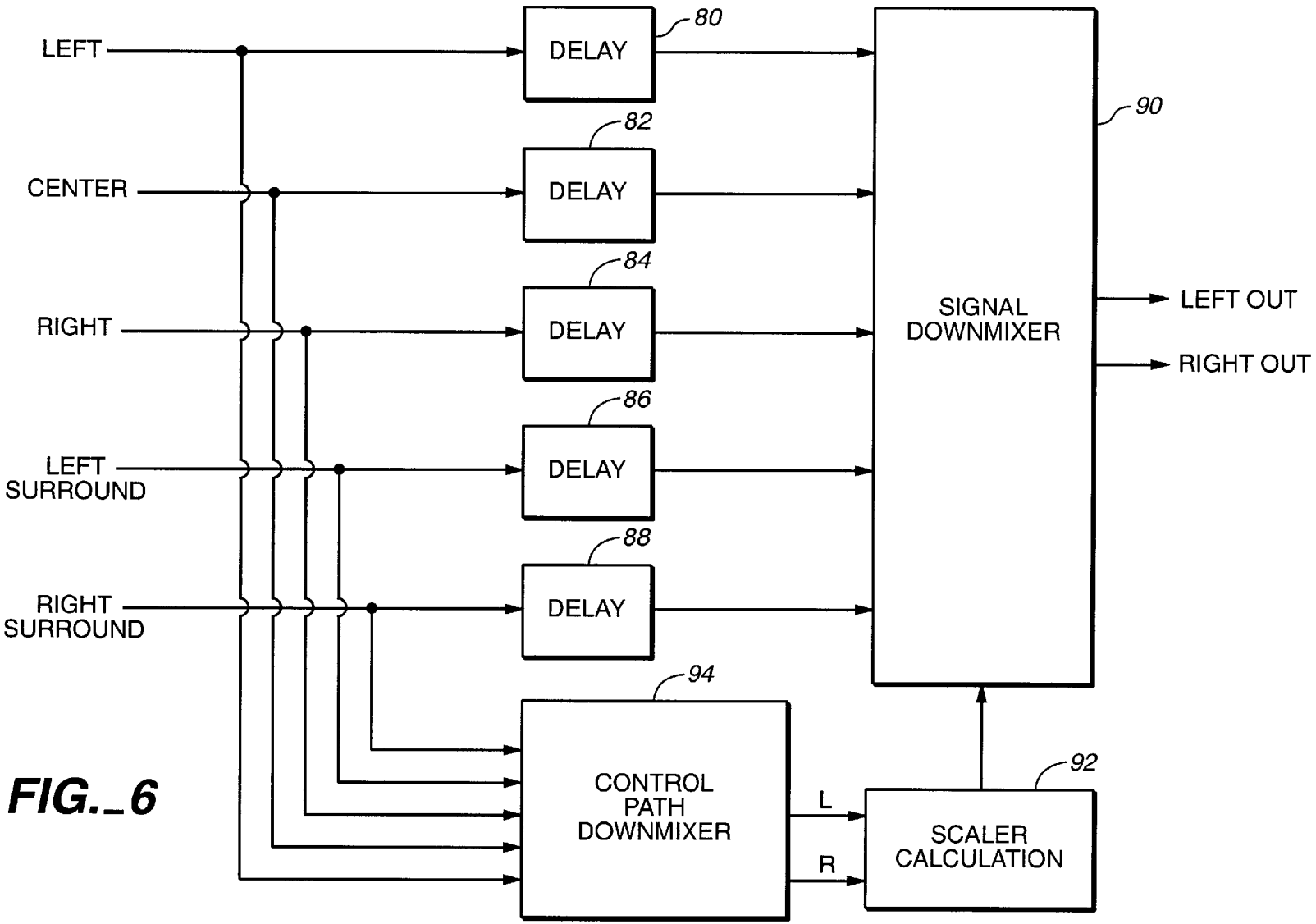
FIG. 6 is a functional block diagram showing a realization of the downmixer and output compressor/limiter of FIG. 4A or 4B.

FIG. 6 is a functional block diagram showing a realization of the downmixer and output compressor/limiter 58. It should be noted that the output compressor/limiter forming part of block 58 provides limiting in addition to the limiting provided in the FIG. 5 embodiment of the crosstalk canceller. As front signals are added to surround signals, as in FIG. 6, the peak level is likely to increase, giving rise to the need for an output compressor/limiter.

Referring to the details of FIG. 6, the inputs (left, center, right, left surround and right surround) are the outputs of blocks 50, 52, 54, and 56 in the FIG. 4A embodiment (or, alternatively, the outputs of blocks 50, 54 and 56 in the FIG. 4B embodiment). Delays 80, 82, 84, 86 and 88 are optional. The use of delays would allow for the smoothing of samples that precede clipping by a scaler calculation, described below. The signal downmixer 90 of the downmixer and output compressor/limiter 58 sums the left, center and left surround inputs to produce the Left Out output and it sums the right, center and right surround inputs to produce the Right Out output. The amplitude level of the Left Out and Right Out output signals are varied in accordance with a scaler coefficient generated by a scaler calculation function 92. The inputs to the scaler calculation function are the left and right outputs of a control path (modelling) downmixer 94.

The control path downmixer provides the same downmixing function as the signal downmixer, mixing the 5.1 (only 5 shown) inputs to 2 outputs. However, the control path downmixer includes attenuation to assure no signal clipping under any input signal conditions. The exact amount of attenuation is not critical. If Left Out=Left+Left Surround (from the crosstalk-canceller)+0.707 Center+0.707 Subwoofer, the maximum output could be 3.414 (same for Right Out), so attenuation of at least the inverse of 3.414 is adequate. Since the compressor/limiter only works at high signal levels and the controller is not in the signal path, high signal-to-noise ratio is not required, so attenuation by 4 or 5 would be adequate. Once downmixed to Left and Right, the scaler calculation uses the larger of the Left and Right inputs to generate a scaler coefficient of 1.0 or less to limit the gain uniformly in the signal path downmixer 90.

It should be understood that implementation of other variations and modifications of the invention and its various aspects will be apparent to those skilled in the art, and that the invention is not limited by these specific embodiments described. It is therefore contemplated to cover by the present invention any and all modifications, variations, or equivalents that fall within the true spirit and scope of the basic underlying principles disclosed and claimed herein.

We claim:

1. A 2×2 port audio crosstalk-cancelling network for mapping two audio source channels, each having an associated source direction, to two audio presentation channels, each adapted for application to a respective one of a pair of transducers, each transducer having a position relative to the source directions, wherein the cross-talk cancelling network implements a matrix C of dimension 2×2 in which each of the matrix elements is a frequency-domain transfer function and said matrix C is the inverse of a room matrix R in which each of the matrix elements is also a frequency-domain transfer function, the matrix R representing a 2×2 port network for mapping two transducer positions to two listening positions. the left ear and the right ear of a listener, the network comprising a first signal combiner and a second signal combiner, each signal combiner having at least two inputs and an output, wherein one of said source channels is coupled to an input of said first signal combiner and another of said source channels is coupled to an input of said second signal combiner, and one of said audio presentation channels is coupled to the output of said first signal combiner and another of said audio presentation channels is coupled to the output of said second signal combiner, and two signal feedback paths, a first signal feedback path and a second signal feedback path, each feedback path having a time delay and frequency dependent characteristic, and each feedback path having an input and an output, wherein the input of said first signal feedback path is coupled to the output of said first signal combiner and the output of said first signal feedback path is coupled to the other input of said second signal combiner, the input of said second signal feedback path is coupled to the output of said second signal combiner and the output of said second signal feedback path is coupled to the other input of said first signal combiner, each of said feedback paths has a time delay representing the additional time for sound to propagate along the acoustic path between a transducer and the listener's ear farthest from said transducer with respect to the time for sound to propagate along the acoustic path between the same transducer and the listeners ear closest to said same transducer, and each of said feedback paths has a frequency dependent characteristic representing the smoothed difference in the attenuation in the acoustic path between a transducer and the listener's ear farthest from said transducer and the attenuation in the acoustic path between the same transducer and the listener's ear closest to said same transducer, wherein said smoothed difference in the attenuation is implemented by one or more simple digital filters requiring low processing power, said signal combiners, signal feedback paths, and couplings therebetween having polarity characteristics such that signals processed by a feedback path arc subtractively combined with signals coupled to the other input of the respective signal combiner, fixed amplitude level attenuators in each of the network's inputs, and variable amplitude level boosters in each of the network's outputs, the boosters each including a scaler for scaling the boost between a level which restores the input attenuation and an attenuated level which avoids clipping in the output signal.

2. A network according to claim 1 wherein said fixed amplitude level attenuators in each of the network's inputs and said variable amplitude level boosters in each of the network's outputs comprise an amplitude compressor and control for the compressor is obtained from the compressor input.

3. A network according to claim 2 said compressor further includes a delay in each of the network's outputs so that the control for the compressor looks ahead in order to syllabically control the compressor's gain.

4. A network according to claim 2 wherein said fixed amplitude level attenuators and variable amplitude level boosters have frequency dependent characteristics.

5. A network according to claim 4 wherein the frequency dependent characteristics of said fixed amplitude level attenuators and variable amplitude level boosters operate only at mid to low frequencies.

6. A network according to claim 2 wherein said fixed amplitude level attenuators and variable amplitude level boosters have frequency-independent characteristics.

7. A network according to claim 1 wherein said fixed amplitude level attenuators in each of the network's inputs and said variable amplitude level boosters in each of the network's outputs comprise an amplitude compressor and said compressor has an infinite compression ratio, whereby the compressor constitutes a limiter.

8. A2×2 port audio crosstalk-cancelling network for mapping two audio source channels, each having an associated source direction, to two audio presentation channels, each adapted for application to a respective one of a pair of transducers, each transducer having a position relative to the source directions, wherein the crosstalk cancelling network implements a matrix C or dimension 2×2 in which each of the matrix elements is a frequency-domain transfer function and said matrix C is the inverse of a room matrix A in which each of the matrix elements is also a frequency-domain transfer function, the matrix R representing a 2×2 port network for mapping two transducer positions to two listening positions, the left ear and the right ear of a listener, the network comprising a first signal combiner and a second signal combiner, each signal combiner having at least two inputs and an output, wherein one of said source channels is coupled to an input of said first signal combiner and another of said source channels is coupled to an input of said second signal combiner, and one of said audio presentation channels is coupled to the output of said first signal combiner and another of said audio presentation channels is coupled to the output of said second signal combiner, and two signal feedback paths, a first signal feedback path and a second signal feedback path, each feedback path having a time delay and frequency dependent characteristic, and each feedback path having an input and an output, wherein the input of said first signal feedback path is coupled to the output of said first signal combiner and the output of said first signal feedback path is coupled to the other input of said second signal combiner, the input of said second signal feedback path is coupled to the output of said second signal combiner and the output of said second signal feedback path is coupled to the other input of said first signal combiner, each of said feedback paths has a time delay representing the additional time for sound to propagate along the acoustic path between a transducer and the listener's ear farthest from said transducer with respect to the time for sound to propagate along the acoustic path between the same transducer and the listener's ear closest to said same transducer, and each of said feedback paths has a frequency dependent characteristic representing the smoothed difference in the attenuation in the acoustic path between a transducer and the listener's ear farthest from said transducer and the attenuation in the acoustic path between the same transducer and the listener's ear closest to said same transducer, wherein said smoothed difference in the attenuation is implemented by one or more simple digital filters requiring low processing power, said signal combiners, signal feedback paths, and couplings therebetween having polarity characteristics such that signals processed by a feedback path are subtractively combined with signals coupled to the other input of the respective signal combiner, fixed amplitude level attenuators in each of the network's inputs, and variable amplitude level boosters in each of the network's outputs.

9. A network according to claim 8 wherein said variable amplitude level boosters boost between a level which restores the input attenuation and a reduced level which avoids clipping in the output signal.

10. A network according to any one of claims 1–9 further comprising a pair of transducers, wherein said presentation channels are coupled to said pair of transducers and said transducers are adapted for placement generally in front of a listener and at substantially right-and-left symmetrical positions with respect to the listener.

11. A network according to claim 10 wherein the frequency dependent characteristic is a first order low-pass shelving characteristic and the low-pass shelving characteristic has a first inflection point at about 2000 Hz and a second inflection point at about 4370 kHz when the audio signal processing apparatus outputs are for application to a pair of transducers spaced at about 15 degrees.

12. A network according to claim 10 wherein the frequency dependent characteristic is a first order low-pass shelving characteristic and the low-pass shelving characteristic has a first inflection point at about 1600 Hz and a second inflection point at about 4150 kHz when the audio signal processing apparatus outputs are for application to a pair of transducers spaced at about 20 degrees.

13. A network according to any one of claims 1–9 wherein the frequency dependent characteristic is a first order low-pass shelving characteristic.

14. A network according to claim 13 wherein the first-order low-pass shelving characteristic or a combination FIR/IIR filter.

15. A network according to any one of claims 1–9 wherein said one or more digital filters requiring low processing power are first order filters.

* * * * *